US005868373A

United States Patent [19]

Duff

[11] Patent Number: 5,868,373

[45] Date of Patent: Feb. 9, 1999

[54] BOOK EASEL

[76] Inventor: Glen Wade Duff, 304 St. George's Blvd., Williamsburg, Va. 23185

[21] Appl. No.: 944,505

[22] Filed: Oct. 6, 1997

[51] Int. Cl.[6] ..... A47B 97/04

[52] U.S. Cl. ..... 248/459

[58] Field of Search ..... 248/459, 460, 248/441.1, 300; 428/108

[56] References Cited

U.S. PATENT DOCUMENTS

| | | | |
|---|---|---|---|
| 582,333 | 5/1897 | Wright | 248/459 |
| 591,089 | 10/1897 | Berbecker | 248/459 |
| 1,399,507 | 12/1921 | Mills, Jr. | 248/459 |
| 1,666,400 | 1/1928 | Rose | 248/459 |
| 2,277,494 | 7/1942 | Loewenstein | 248/459 |
| 2,587,316 | 2/1952 | Henry | 248/459 |
| 2,652,647 | 9/1953 | Suciu | 40/661.08 |
| 2,832,176 | 4/1958 | Vergeer | 40/124.1 |
| 3,007,278 | 8/1961 | Million | 45/85 |
| 3,990,669 | 11/1976 | Smith | 248/459 |
| 4,204,016 | 5/1980 | Chavannes | 428/108 |
| 4,318,527 | 3/1982 | Smith | 248/459 |
| 4,377,271 | 3/1983 | Smith | 248/460 |
| 5,388,798 | 2/1995 | Glick | 248/459 |

*Primary Examiner*—Leslie A. Braun
*Assistant Examiner*—Anita M. King
*Attorney, Agent, or Firm*—Armstrong, Westerman, Hattori, McLeland & Naughton

[57] ABSTRACT

A book easel for supporting an open book on a work surface is formed of a piece of bendable sheet material having a generally flat bottom edge for resting on the work surface and a center crease, generally perpendicular to the bottom edge. The center crease divides the book easel into similar left and right sections. Each of the left and right sections include a center panel, a supporting panel and a foot panel. The center panel is adjacent to the center crease, such that the left and right center panels are angled with respect to one another. The supporting panel extends outwardly from the center panel, and the foot panel extends outwardly from a remote end of the supporting panel. A left crease is formed between the center and supporting panel on the left side and the right crease is formed between the center and supporting panel on the right side. The center panel has an upper edge extending from the center crease upwardly to an intersection with the supporting panel. Further, the support panel has an upper load supporting edge for supporting a book cover, the load supporting edge extending downwardly, with respect to the bottom edge, from the intersection with the center panel to the foot panel. Furthermore, the foot panel extends upwardly, above an intersection of the support panel with a foot panel, in order to support the bottom edge of a book cover.

17 Claims, 4 Drawing Sheets

BOOK EASEL

BACKGROUND OF THE INVENTION

The instant invention is directed to a book easel for supporting an open book on a work surface. More particularly, the invention is directed to an inexpensive and easily manufactured book easel. This book easel may be made of a sheet material and folded flat for easy transportation.

In the past, many different types of easels for supporting an open book on a work surface have been used. For example, many book easels have been made out of wire. The use of wire provides for a strong book easel, however, it is also rather expensive to manufacture. Such easels are also often difficult to transport. Other easels have been produced in which it is not practical to turn the pages of a book when set in the easel.

It is an object of the instant invention to provide a book easel for supporting an open book on a work surface, which allows the reader the unique ability to turn the pages freely.

It is another object of the invention to provide a book easel which is easy and inexpensive to manufacture and has a printable surface that may be used for decoration and useful information.

It is still another object of the invention to provide a book easel which not only lifts the book for better ergonomic reading, but it also saves desk or table space, because of its efficient triangular foot print.

SUMMARY OF THE INVENTION

The present book easel, in accordance with the instant invention, is provided to overcome many problems with previous book easels. Because the instant invention may be made from a sheet material, such as corrugated cardboard, it is inexpensive to manufacture and may be provided to the consumer at a low cost.

The present book easel for supporting a book on a work surface is formed from a piece of bendable sheet material having a generally flat bottom edge for resting on the work surface. The sheet material has a center crease which is generally perpendicular to the bottom edge, dividing the book easel into similar left and right sections. Each of the left and right sections may be divided into three different panels, a center panel, a supporting panel and a foot panel. The center panel is adjacent the center crease, such that the center panels of the left and right sections are angled with respect to one another. The supporting panel extends outwardly from the center panel, and the foot panel extends outwardly from a remote end of the supporting panel.

The center panel has an upper edge extending from the center crease to an intersection with the support panel. Furthermore, the support panel has a load supporting edge for supporting a book cover, wherein the load supporting edge extends downwardly, with respect to the bottom edge, from the intersection with the center panel down to the foot panel. The foot panel extends upwardly, above an intersection with the support panel and the foot panel, in order to support the bottom edge of the book cover.

The upper edges of the center panel may also extend upwardly from the center crease to present a notch area which provides a space for the spine of the book when the open book is supported by the book easel. Furthermore, it should also be noted that the foot panel has a curved profile which curves away from a line perpendicular to the load supporting edge. This enables a bottom edge of the book cover to rest against the foot panel and yet allows the pages to be turned easily, without interference from the foot panel.

Also, left and right creases between the center panels and the support panels on each side provide for additional steadiness of the structure itself. Furthermore, it should also be noted that a flute wire may be inserted near a bottom edge of a book easel to add support and the prevent the book easel from springing outwardly when trying to set a book in it.

The above, and other structural features of the instant invention, enable the instant book easel to hold an open book at a good viewing angle and allows easy page turning for reading or studying. Furthermore, it is very cost efficient to manufacture and therefore may be marketable at a very reasonable cost to a wide consumer base. It is therefore possible to include school-age children in the customer base since the instant book easel is an ideal study aid for school-age children. Of course, the instant book easel need not be limited only to the school-age group. One benefit is that it helps to gain an additional space on a desk for studying because of its triangular foot print when in use. It is easy to fold flat for transporting from classroom to classroom or from classroom to home. It has large size surfaces which provide a place to print popular design images to make them more attractive to customers. In fact, a collection of useful and informative information may be printed on the inside and/or outside of the book easel.

DETAILED DESCRIPTION THE INVENTION

The invention will be described with reference to the drawings set forth above. The book easel in accordance to the instant invention will first be described with reference to FIGS. 1 and 2.

Figure 1:
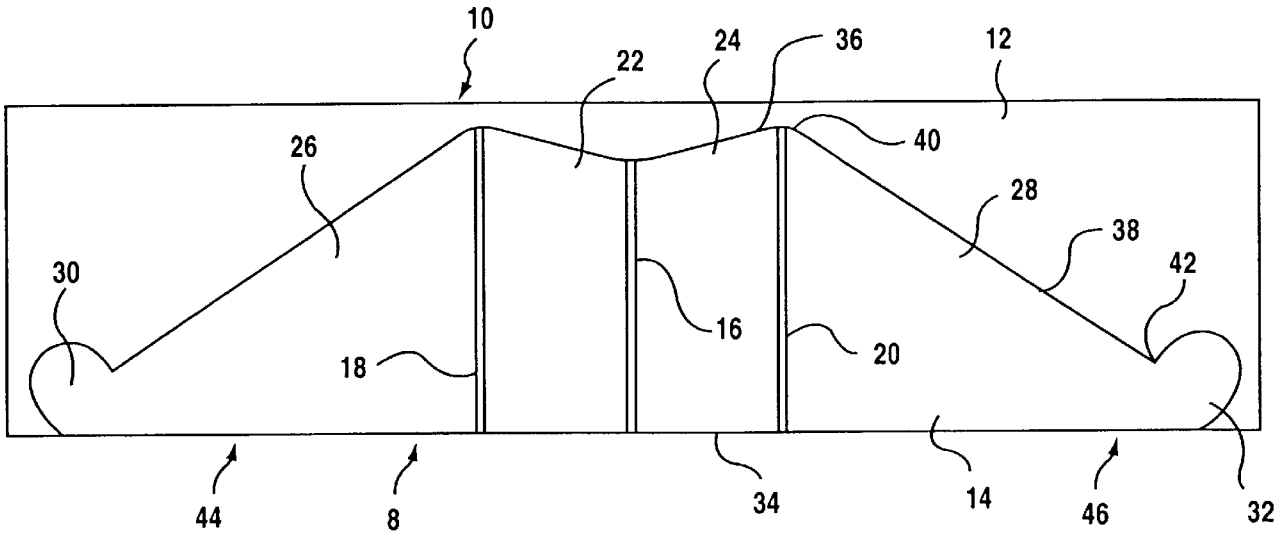
FIG. 1 illustrates the book easel in accordance with the instant invention, as it is produced, before the book easel is separated from a header (or negative area) portion.

FIG. 1 illustrates the manufacture of the book easel 8. Specifically, a cardboard blank 10 includes a header piece 12 (or negative area) and a main piece 14. The cardboard blank is made of corrugated cardboard. Corrugated cardboard is a preferable material for use with the instant book easel. However, many other types of sheet material may also be used. For example, corrugated plastic, plastic, metal, wood, vinyl over paperboard, paper over paperboard and any other suitable sheet material may be used to form the instant book easel.

When manufactured, the outline of the main piece of bendable sheet material 14 is die cut into the cardboard blank 10. The portion of the cardboard blank 10 which is not used in the book easel 8 is the header 12 (or negative area). However, this need not simply be wasted since the header 12 may be utilized to package and promote the product at the point of purchase. Thus the book easel, according to the instant invention, may be self packaged. This provides for a useful function for what would normally be wasted.

Figure 2:
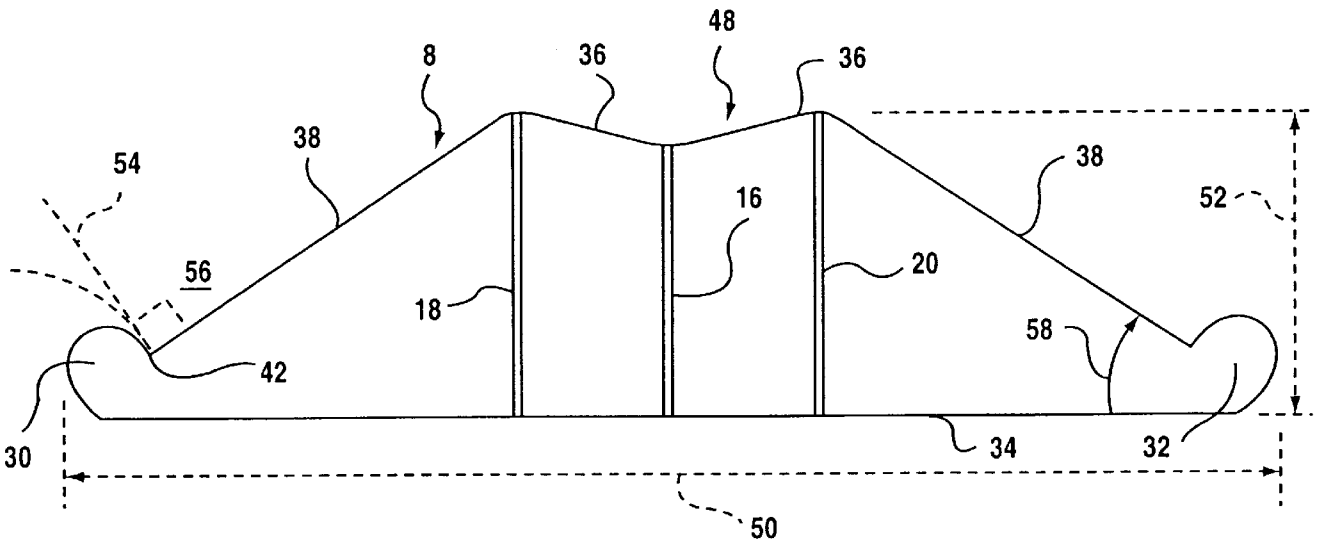
FIG. 2 illustrates the book easel, still in a flat stage, but after being removed from the header portion.

Specifically, as seen in FIGS. 1 and 2, the main piece of bendable sheet material 14 has a bottom edge 34 which is generally flat and straight. Center crease 16 is substantially perpendicular to bottom edge 34 and divides the main piece 14 into left and right side sections. The left side section is indicated by reference numeral 44 and the right side section is indicated by reference numeral 46. Main piece 14 includes left and right center panels 22, 24, left and right support panels 26, 28 and left and right foot panels 30, 32, respectively.

Since the left and right side sections 44 and 46 are substantially mirror images of one another, the right side section 46 will be described. Corresponding portions of the left side section 44 are similar.

A left crease 18 and a right crease 20 are both generally perpendicular to bottom edge 34 and spaced apart from and generally parallel to center crease 16. Center crease 16, left crease 18 and right crease 20 may be formed by double scoring main piece 14. Of course, any type of practical bending method may be used. Center panel 24 has an upper edge 36. Upper edge 36 extends upwardly from center crease 16 to an intersection 40 between the center panel and support panel. Intersection 40 is at substantially the same place as right crease 20. While upper edge 36 preferably extends upwardly from center crease 16 to intersection 40, it may also be straight across. Load supporting edge 38 extends downward, with respect to the bottom edge 34 from intersection 40. Load supporting edge 38, thus, extends downwardly from intersection 40 to intersection 42, between support panel 28 and foot panel 32.

FIG. 2 illustrates the main piece of bendable sheet material 14 after having the header 12 removed therefrom. FIG. 2 illustrates the invention before it has been folded along creases 16, 18 and 20. In fact, it may be possible to use the invention without left crease 18 and right crease 20, however, it is much more preferable to provide left crease 18 and right crease 20 in order to enable a book supported by the book easel to be steadier. As seen in FIG. 2, upper edge 36 of the center panel on the right side section and upper edge 36 of the center panel on the left side section, both extend upwardly from the center crease 16. Thus, a notch area 48 is formed above the left and right center panels. This notch area provides a space for the spine of a book when the book is supported by the book easel. Reference numeral. 50 indicates the total length of the book easel, before being folded, and reference numeral 52 indicates the height of the book easel. For most uses, it is preferable that the length be less than 24 inches and the height be less than 6 inches. Of course for larger books, it may be necessary to employ easels having a greater length and greater height. A preferable size for the easel is for the length to be about 22.6 inches and the height to be about 5.8 inches.

Please note, in FIG. 2, that load supporting edge 38 on the left side section of the easel intersects foot panel 30 at intersection 42, the same as on the right side. A line of 54 is perpendicular to load supporting edge 38 and extends outwardly from intersection 42. Please note that foot panel 30 does not extend into an area 56 defined between the load supporting edge 38 of the support panel and line 54 which is perpendicular to the load supporting edge 38. In fact, foot panel 30 has a curved profile which actually curves away from perpendicular line 54. This is an important feature because it allows the bottom of the book cover to bear against foot panel 30, while allowing pages in the book to be freely turned. In many of the conventional book easels, it is very difficult to turn pages because the feet of conventional book easels hold the bottom of the book cover, but also prevent pages from being easily turned.

Also, as seen in FIG. 2, arrow 58 represents the angle between the load supporting edge 38 and bottom edge 34. While many different angles may be used, it is preferable that an angle between 30° and 45° be used. Furthermore, experimentation has shown that a most preferable angle is about 34°. The proper angle enables the pages to be easily turned and the inner friction between pages will help to keep the pages from "slumping" down toward the foot panels 30 and 32.

Figure 3:
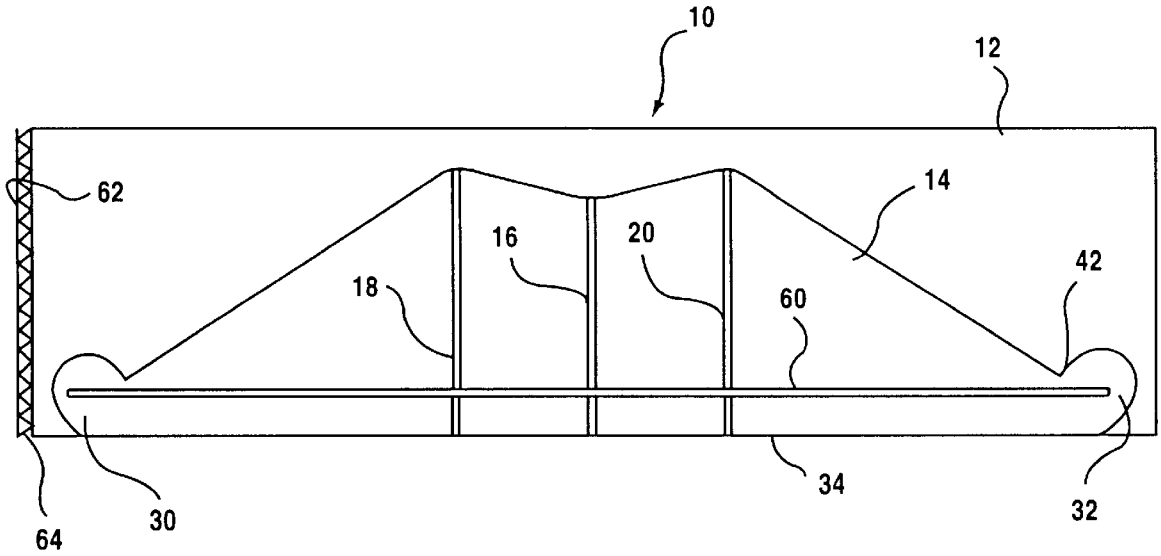
FIG. 3 illustrates the book easel, still in a flat stage, with a flute wire inserted therein.

FIG. 3 illustrates the use of a flute wire 60. A flute wire 60 is secured in the main piece of the bendable sheet material 14 (in this case corrugated cardboard) by simply inserting it into edge 62 of the corrugated cardboard, along one of the corrugations. It is advantageous to have the corrugations and the cardboard running generally parallel with bottom edge 34. This is clearly seen from the corrugation 64 along the edge 62 of the corrugated cardboard itself. It is preferable that the cardboard blank 10 be die cut to form header 12 and main piece 14 before the flute wire is installed. The flute wire 60 may then be easily slid into place. While many different sizes of flute wire may be employed, 18 and 20 gauge flute wire seem to be most effective and thus preferable. This flute wire is a soft, bendable wire. It gives structural support to the book easel. Once the easel is folded along center crease 16 (as well as left crease 18 and right crease 20), it prevents the easel from springing open while laying in the position. Furthermore, the flute wire 60 supports the weakest portion of the easel made out of corrugated cardboard, which is the narrow portion around intersection 42 between the support panel and the foot panel.

Figure 4:
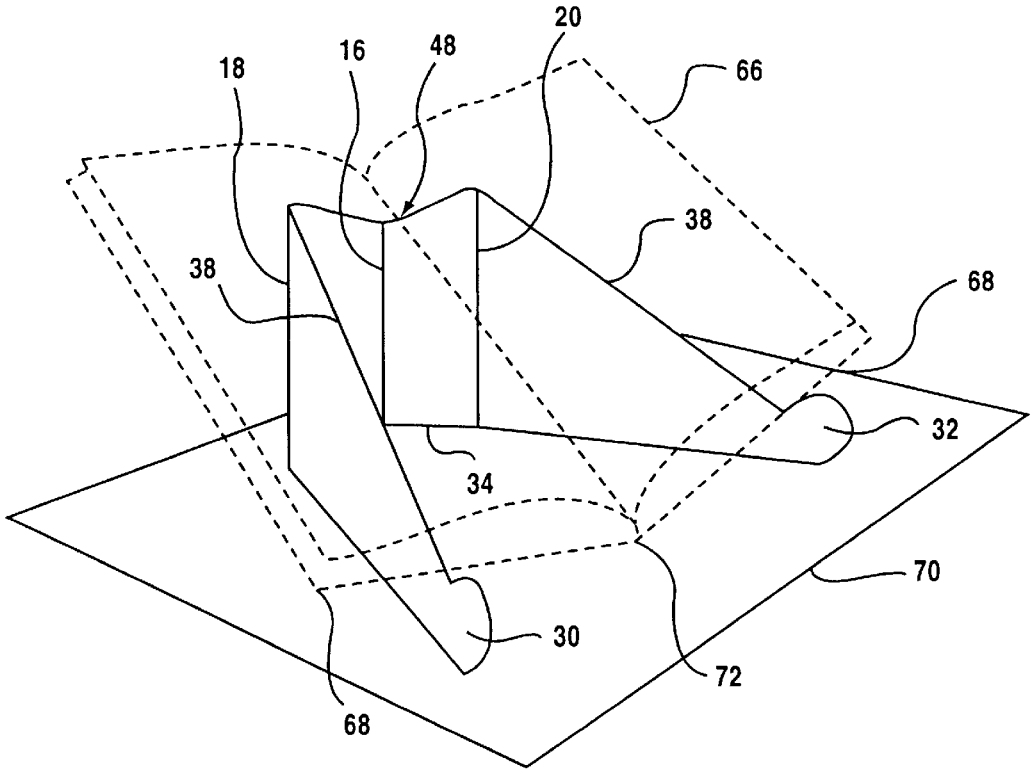
FIG. 4 illustrates the book easel in its operative (or bent) orientation, with a book indicated in phantom.

FIG. 4 is a perspective view illustrating a book 66 sitting on the book easel. Work surface 70 supports the bottom edge 34 of the main piece 14. It is clearly seen in FIG. 4 that the main piece 14 is bent at center crease 16, left crease 18 and right crease 20. It can be seen that the spine of the book occupies space at notch area 48. An important feature to notice is that because of the design of the instant book easel, the book touches the work surface 70 at the base of the spine 72 of the book. Furthermore, the bottom edge of book cover 68 rests against the left and right foot panels 30, 32. Thus, the weight of the book is[]supported along load supporting edges 38, on foot panel of 30, 32, and at the base of the spine 72 of the book itself. This provides for a highly stable support for a book.

Figure 5:
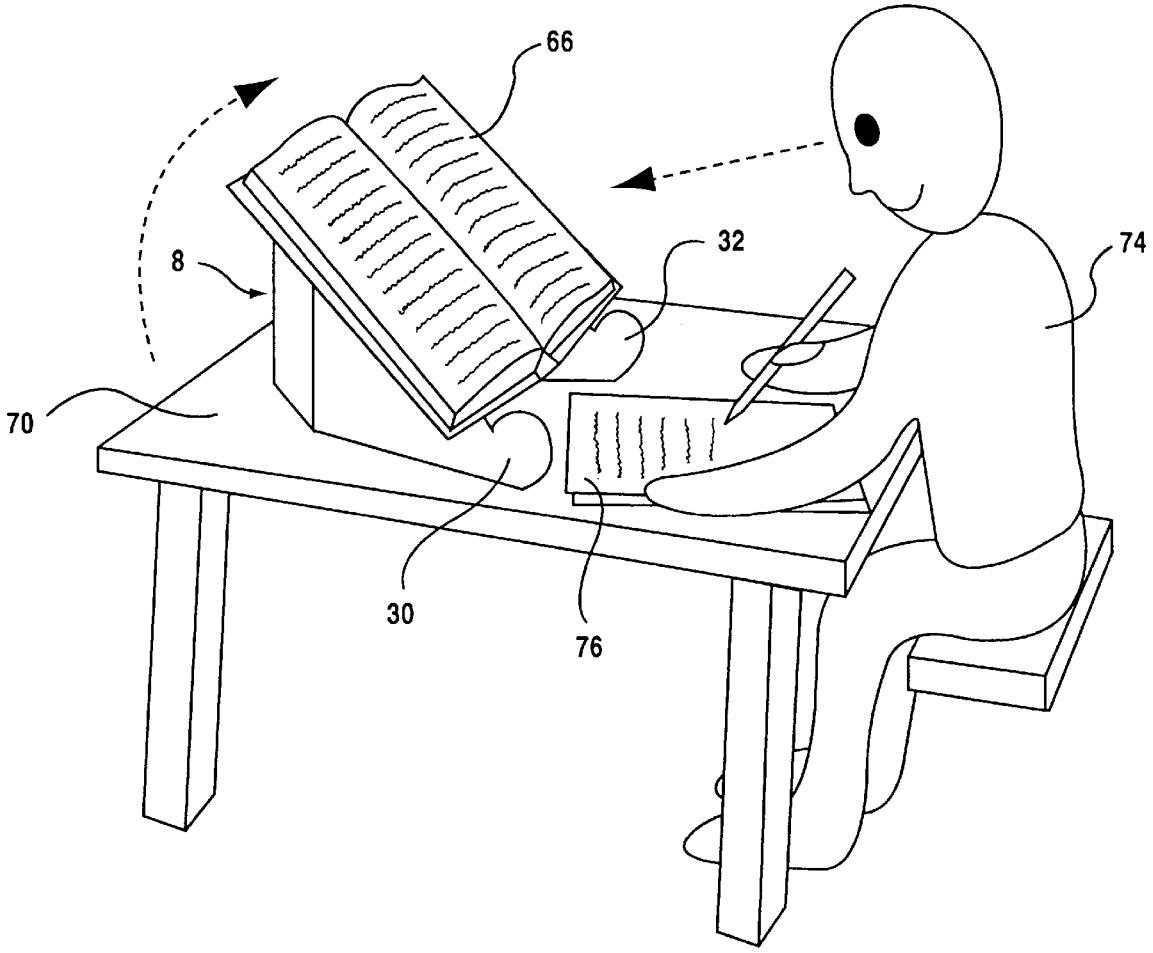
FIG. 5 illustrates an individual working at a desk with the book easel according to the instant invention.

FIG. 5 illustrates a user 74, such as a student, employing the book easel 8 and also using work papers 76. Because of the design of the book easel 8, it has an open area between foot panels 30 and 32 which work papers 76 may nest into. FIG. 5 specifically illustrates how the book easel helps support an open book for better ergonomic reading (compared to an open book on a table). Further, FIG. 5 illustrates the advantage of book easel 8 in saving space on a desk or table because of its space-efficient triangular foot print.

Figure 6:
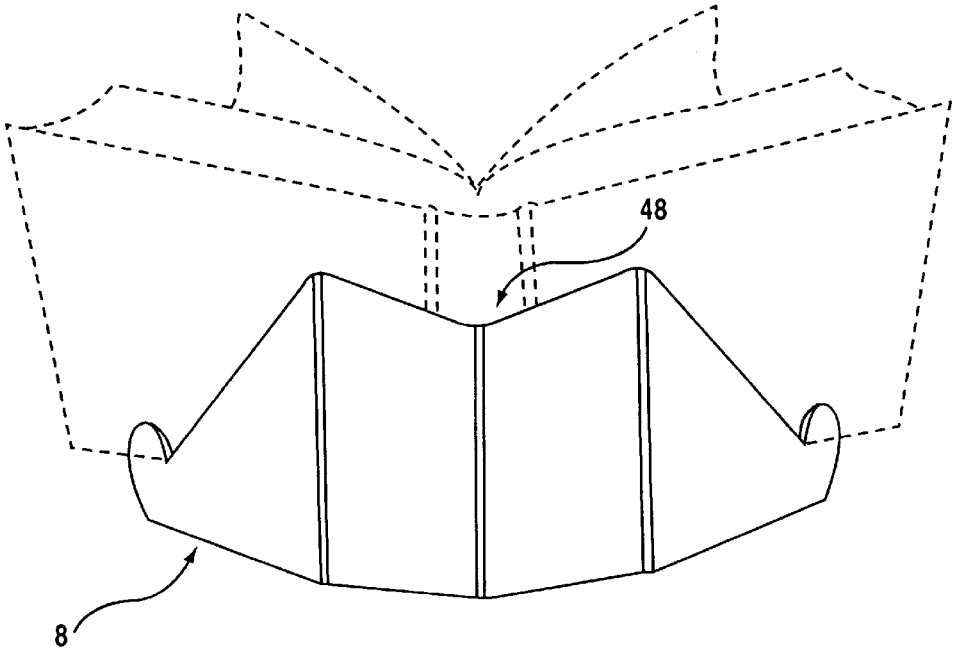
FIG. 6 illustrates a rear view of the book easel in operation, with a book indicated in phantom.

FIG. 6 illustrates the back of the book easel 8 in position with a book indicated in phantom. As can be seen from FIG. 6, notch area 48 provides space for the book spine to occupy when it is sitting on the book easel. Also, it can be clearly seen that the book easel 8 has a large amount of space for designs or colors which would attract a consumer.

Figure 7:
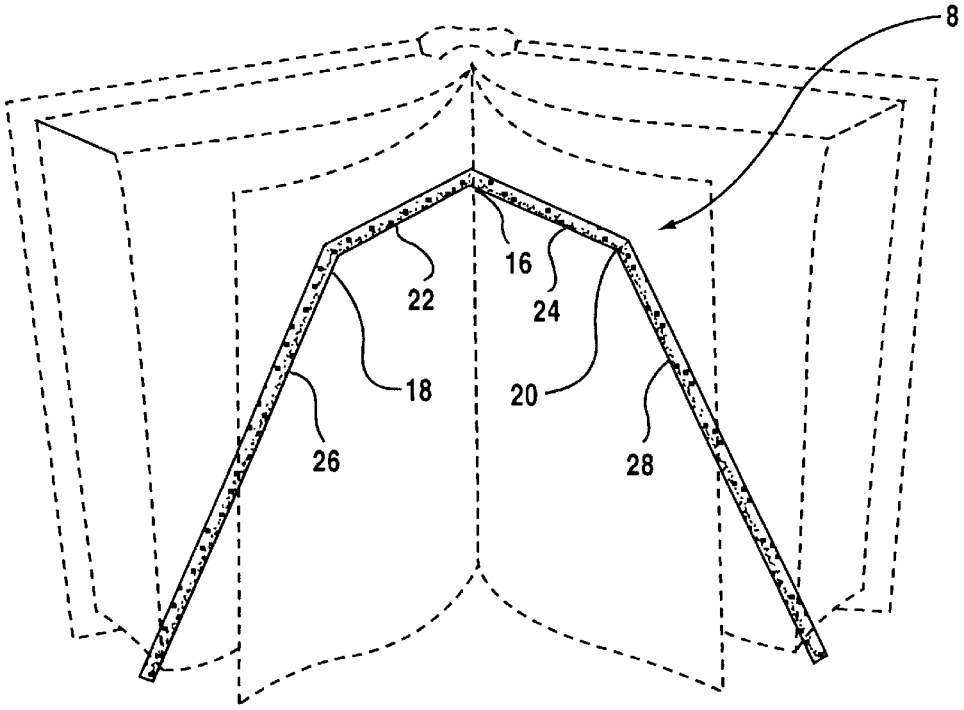
FIG. 7 is a plan view showing the book easel from above, with a book indicated in phantom.

FIG. 7 is a plan view illustrating the book easel 8 from above, when in use. As can be clearly seen from FIG. 7, center panels 22 and 24 are separated by center crease 16. Center panels 22 and 24 are thus angled with respect to one another. Furthermore, in this preferable embodiment, left crease 18 provides left center panel 22 from left support panel 26. Thus, left center panel 22 is angled with respect to left support panel 26. On the right side of book easel 8, right crease 20 divides right center panel 24 from right support panel 28. Thus, right center panel 24 is angled with respect to right support panel 28. This structure provides more stability for supporting the book under many conditions. When inserted with the flute wire, the book easel 8 may be opened in to a position similar to that illustrated FIG. 7 and a book may be easily situated onto the easel without having the easel spring open farther.

In use, it is preferable that the consumer may purchase the instant book easel in a configuration similar to that illustrated in FIG. 1. The header 12 may then be separated from the main piece 14 by folding and breaking nicks formed by the die cutting process. The easel may then be bent to provide center crease 16, left crease 18 and right crease 20. With the proper configuration now, as illustrated in FIG. 7, a book may be easily placed onto the book easel for studying or other use. When transported, it is easy to fold the book easel 8 flat along center crease 16. The book easel 8 may then be inserted into a book or book bag or backpack or any other carrying case for easy transportation to another class or a different location.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. A book easel for supporting an open book on a work surface, said book easel comprising:

a piece of bendable sheet material having a generally flat bottom edge for resting on the work surface and a center crease, generally perpendicular to said bottom edge, said center crease dividing the book easel into similar left and right side sections, each of said sections including, a center panel adjacent said center crease, such that said center panels of the left and right side sections are angled with respect to one another, a supporting panel extending outwardly from said center panel, and a foot panel extending outwardly from a remote end of said supporting panel, wherein said center panel has an upper edge extending from said center crease to a first intersection with said supporting panel, wherein said supporting panel has an upper load supporting edge for supporting a book cover, said load supporting edge extending downwardly, with respect to said bottom edge, and outwardly with respect to said center crease, from said intersection with said center panel to said foot panel, and wherein said foot panel extends upwardly, above a second intersection of said supporting panel with said foot panel, in order to support a bottom edge of the book cover.

2. The book easel of claim 1, wherein said upper edge of said center panel extends upwardly, with respect to said bottom edge, from said center crease to said intersection with said support panel, such that a notch area is formed above both center panels.

3. The book easel of claim 1, wherein a left crease is formed at the intersection between said center and supporting panels of the left side section, and a right crease is formed at the intersection between said center and supporting panels of the right side section, wherein said center and supporting panels, of each side section, are angled with respect to one another.

4. The book easel of claim 3, wherein said left and right creases are generally perpendicular with respect to said bottom edge.

5. The book easel of claim 4, wherein said center, left and right creases are double scored lines on said sheet material.

6. The book easel of claim 1, wherein said foot panel has a profile which does not extend into an area defined between said load supporting edge of said supporting panel and a line perpendicular to said load supporting edge and extending outwardly from said intersection between said supporting panel and said foot panel.

7. The book easel of claim 6, wherein said foot panel has a curved profile, which curves away from said perpendicular line.

8. The book easel of claim 1, further comprising a flute wire extending generally parallel to and spaced apart from said bottom edge, wherein said flute wire is secured to said sheet material.

9. The book easel of claim 8, wherein said sheet material is corrugated cardboard with said corrugations running generally parallel to said bottom edge.

10. The book easel of claim 9, wherein said flute wire is disposed within a corrugation of said corrugated cardboard.

11. The book easel of claim 10, wherein said flute wire is 18 gauge wire.

12. The book easel of claim 10, wherein said flute wire is 20 gauge wire.

13. The book easel of claim 1, wherein an angle formed between said load supporting edge and said bottom edge is between 30° and 45°.

14. The book easel of claim 13, wherein said angle is about 34°.

15. The book easel of claim 1, wherein the total length of the book easel is less than 24 inches and the height is less than 6 inches.

16. A book easel for supporting an open book on a work surface, said book easel comprising:

a piece of bendable sheet material having a generally flat bottom edge for resting on the work surface and a center crease, generally perpendicular to said bottom edge, said center crease dividing the book easel into similar left and right side sections, each of said sections including, a center panel adjacent said center crease, such that said center panels of the left and right side sections are angled with respect to one another, a supporting panel extending outwardly from said center panel, and a foot panel extending outwardly from a remote end of said supporting panel, wherein said center panel has an upper edge extending upwardly from said center crease to an intersection with said supporting panel, to form a notch area above both center panels, wherein said supporting panel has an upper load supporting edge for supporting a book cover, said load supporting edge extending downwardly, with respect to said bottom edge, and outwardly with respect to said center crease, from said intersection with said center panel to foot panel, wherein said foot panel extends upwardly, above an intersection of said supporting panel with said foot panel, in order to support a bottom edge of the book cover, said foot panel having a curved profile which curves away from a line perpendicular to said load supporting edge and extending outwardly from said intersection of said supporting panel and said foot panel, and wherein a left crease is formed at the intersection between said center and support panels of the left side section, and a right crease is formed at the intersection between said center and supporting panels of the right side section, wherein said center and support panels, of each side section, are angled with respect to one another.

17. The book easel of claim 16, further comprising a flute wire extending generally parallel to and spaced apart from said bottom edge, said flute wire being secured in corrugations in said sheet material.

* * * * *